United States Patent [19]

Jensen et al.

[11] 4,101,006

[45] Jul. 18, 1978

[54] CARRIER TRAVERSE CONTROL FOR A SERIAL PRINTER

[75] Inventors: Donald F. Jensen, Endicott; Arnold B. Rosenthal, Vestal; Charles O. Ross, Endicott, all of N.Y.

[73] Assignee: International Business Machines Corporation, Armonk, N.Y.

[21] Appl. No.: 535,647

[22] Filed: Dec. 23, 1974

[51] Int. Cl.[2] ..... B41J 19/30

[52] U.S. Cl. ..... 400/144.3; 400/305; 318/600; 318/696; 400/279; 400/320; 400/322

[58] Field of Search ..... 197/16, 18, 49, 53, 197/54; 101/93.18, 93.19; 318/600, 685, 696

[56] References Cited

U.S. PATENT DOCUMENTS

| | | | |
|---|---|---|---|
| 3,168,182 | 2/1965 | Bernard et al. | 197/49 UX |
| 3,289,805 | 12/1966 | Kleinschmidt et al. | 197/53 X |
| 3,371,766 | 3/1968 | Staller | 197/53 |
| 3,636,867 | 1/1972 | Bonzano | 197/16 |
| 3,659,524 | 5/1972 | Beery et al. | 101/93.19 |
| 3,789,971 | 2/1974 | Deyesso et al. | 197/18 |
| 3,884,339 | 5/1975 | Castoldi et al. | 197/53 |
| 4,044,880 | 8/1977 | Martin | 197/18 |

*Primary Examiner*—Anton O. Oechsle
*Attorney, Agent, or Firm*—John S. Gasper

[57] ABSTRACT

In a serial printer a movable type character element such as a ball, disc or the like is rotated to present different type characters to the print position. The carrier for the type element is moved along the print line at a predetermined maximum velocity so long as it is possible to move the type element to the next character in time required to move the carrier from one print position to the next. If the type character set-up time is greater, the carrier is run at a slower speed and is then returned to the predetermined velocity for printing.

4 Claims, 8 Drawing Figures

| NO. OF CHAR. ROTATED | TIME TO ROTATE BALL & PRINT ($t_t$) | $t_a$ $\times 10^{-3}$SEC | $t_b$ $\times 10^{-3}$SEC | $t_c$ $\times 10^{-3}$SEC | $V_L$ IN/SEC |
|---|---|---|---|---|---|
| 0 | $20 \times 10^{-3}$ SEC | 5 IN/SEC CONSTANT SPEED | | | |
| 1 | 20 | | | | |
| 2 | 20 | | | | |
| 3 | 20 | | | | |
| 4 | 22.5 | 6.0 | .25 | 5.25 | 3 |
| 5 | 25 | 6.0 | 6.5 | 1.5 | 3 |
| 6 | 27.5 | 10.5 | .2 | 1.3 | 1.5 |
| 7 | 30 | 10.5 | 3.8 | .2 | 1.5 |
| 8 | 32.5 | 15.0 | 0 | 0 | 0 |
| 9 | 35 | 15.0 | 0 | 0 | 0 |
| 10 | 37.5 | 15.0 | 2.5 | 0 | 0 |
| 11 | 40 | 15.0 | 5.0 | 0 | 0 |
| 12 | 42.5 | 15.0 | 7.5 | 0 | 0 |

CARRIER VELOCITY PROFILE ASSUMING A BALL ROTATION OF 45° IN $15 \times 10^{-3}$ SEC

ROS ADDRESSING

| | | 00 | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 | 25 | 26 |
|---|---|---|---|---|---|---|---|---|---|---|---|---|---|---|---|---|---|---|---|---|---|---|---|---|---|---|---|---|
| 00 | 000 | X | X | X | X | X | X | X | X | X | X | X | X | | | | | | | | | | | | | | | |
| 01 → | 032 | X | X | X | X | X | X | X | X | X | X | X | X | | | | | | | | | | | | | | | |
| 02 → | 064 | X | X | X | X | X | X | X | X | X | X | X | X | | | | | | | | | | | | | | | |
| 03 | 096 | X | X | X | X | X | X | X | X | X | X | X | X | | | | | | | | | | | | | | | |
| 04 → | 128 | X | X | X | X | X | X | X | | X | | X | X | X | X | | | | | | | | | | | | | |
| 05 | 160 | X | X | X | X | X | X | | X | | X | | X | X | X | X | | | | | | | | | | | | |
| 06 | 192 | X | X | X | X | | X | | X | | X | | X | | X | X | X | X | | | | | | | | | | |
| 07 | 224 | X | X | X | | X | | X | | X | | X | | X | | X | X | X | X | | | | | | | | | |
| 08 → | 256 | X | | X | | X | | X | | X | | X | | X | | X | | X | X | X | X | | | | | | | |
| 09 | 288 | | X | | X | | X | | X | | X | | X | | X | | X | | X | X | X | X | | | | | | |
| 10 | 320 | | X | | | X | | | X | | X | | X | | X | | X | | X | | X | X | X | X | | | | |
| 11 | 352 | | X | | | X | | | X | | | X | | X | | X | | X | | X | | X | X | X | X | | | |
| 12 | 384 | | X | | | X | | * | X | | | X | | | X | | | X | | X | | X | | X | X | X | X | |
| | 416 | | | | | | | | | | | | | | | | | | | | | | | | | | | |

NUMBER OF CHARS. TO BE ROTATED

ROS CHARACTERIZATION FOR CARRIER VELOCITY CONTROL

CARRIER TRAVERSE CONTROL FOR A SERIAL PRINTER

BACKGROUND OF THE INVENTION

1. Field of the Invention

This invention relates generally to serial printers and it has reference in particular to a carrier traverse control for obtaining the maximum output with a ball, stick, or disc printer or the like.

2. Description of the Prior Art

The Willcox, et al. U.S. Pat. No. 3,461,235, issued Aug. 12, 1969, discloses a serial printer in which a print disc rotates continuously and is incremented from one print position to the next along the print line after each rotation of the disc.

The Ponzano U.S. Pat. No. 3,707,214, which issued Dec. 26, 1972, discloses servo systems for moving a print disc and its carrier from one position to another by the shortest route.

The Cahill, et al. U.S. Pat. No. 3,794,150, which issued on Feb. 26, 1974, discloses a carrier structure for a type element which is rotated and moved axially to present selected type characters for printing.

SUMMARY OF THE INVENTION

Generally stated, it is an object of the invention to provide an improved serial printer carrier traverse control.

More specifically, it is an object of the present invention to provide for incrementing a type element from one position to the next selected position while controlling the operation of the carrier so as to reach the desired print position with the carrier moving at a single predetermined on-the-fly speed.

Another object of the invention is to provide for changing the speed of the carrier in a serial printer so that it always arrives at the next print position moving at a predetermined maximum speed.

Yet another object of the invention is to provide for using a read only storage device for gating pulses from an oscillator in accordance with the number of positions a type element must move to present the next character to be printed, so as to control the speed of the type element carrier that it always arrives at the next print position moving at a predetermined maximum speed.

Still another object of the invention is to provide for using a pulse generator to drive a type carrier, and presetting addresses in a read only storage in accordance with the number of character positions it is necessary to move to select the next character to be printed, so as to selectively control the pulses applied to the carrier stepper motor to selectively operate on a number of different velocity profiles in advancing the carrier so as to always reach the next print position moving at a predetermined maximum velocity with the type character selected and ready to print.

It is also an object of the invention to provide for selectively operating a type element carrier stepping motor on a number of different velocity profiles in accordance with the distance the type element must be moved to position the next character to be printed, so that the carrier always arrives at that next print position with the type element properly positioned and the type carrier moving at the same maximum speed.

A further object of the invention is to provide for operating the stepper motor driving a type element carrier along the print line of a document by pulses from a pulse source, determining the number of positions the type element must be moved to present the next type character for printing, and selectively gating different ones of the pulses from said pulse source to said stepping motor in accordance with the number of character positions the type element must be moved.

DESCRIPTION OF A PREFERRED EMBODIMENT

Figure 1:
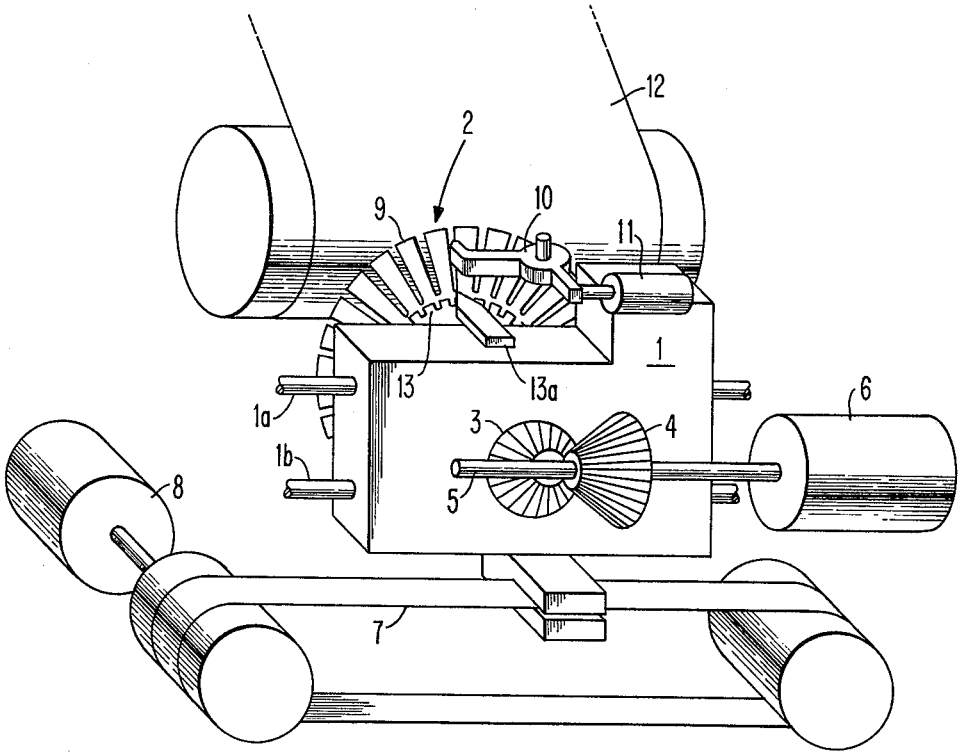
FIG. 1 is a schematic representation of a serial printer structure with which the invention may be utilized.

Referring to FIG. 1 a laterally sliding carrier 1 mounted on guides 1*a* and 1*b* carries a rotatable print wheel 2 driven by a bevel gear 3 which mates with a bevel gear 4 sliding on a splined drive shaft 5 driven by a stepping motor 6. The carrier 1 is driven by a toothed belt or band 7 driven by a stepping motor 8. During the printing of any character, the carrier 1 is always in motion from left to right but it can be stopped and restarted by appropriate control of the stepping motor 8.

The print wheel 2 comprises, for example, a disc having a number of movable type elements such as the flexible spokes or type fingers 9. Printing of any desired character on one of the type fingers 9 is brought about by operating a print hammer 10 which may be actuated by a solenoid 11, both of which are mounted on the carrier 1. When the appropriate type finger 9 approaches the printing position, the solenoid 11 actuates the hammer 10 into contact with the type finger 9 driving it into contact with the paper 12. An emitter wheel 13 rotating with the print wheel 2 cooperates with a magnetic sensor 13*a* to produce a stream of emitter index pulses for controlling the operation of the printer, one for each character with a home pulse for each revolution of the print wheel produced, for example, by having a missing tooth on the emitter 13. The printer controls can thus determine the angular position of the print wheel at any time.

Figures 2, 3:
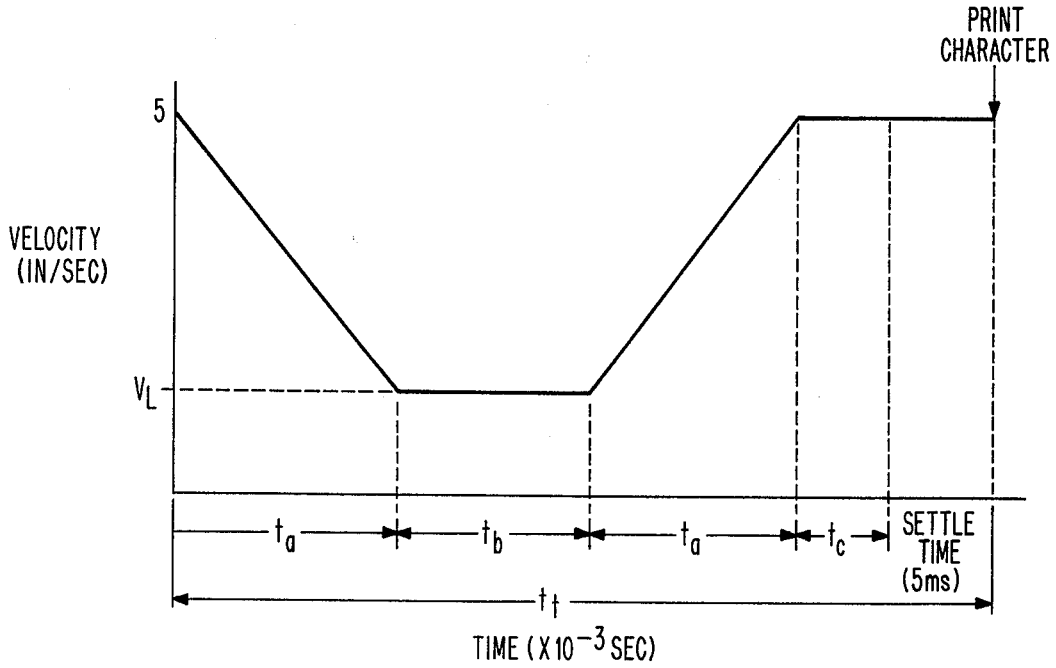
FIG. 2 shows a velocity curve of a typical carrier mechanism embodying the invention.
FIG. 3 is a table of carrier speeds versus the number of positions the type element must be rotated to present the next character for moving the carrier so as to print at the same on-the-fly speed each time.

Present serial printers using a ball or a disc as a print element usually print in an incrementing mode. That is, the print carrier increments one character position, the ball is set up and the character printed. This cycle is then repeated for the next character. The present invention eliminates the increment mode of carrier positioning in favor of the print on-the-fly approach. A carrier velocity is selected, for example, 5 inches per second (50 characters per second). The carrier 1 then traverses the print line at this rate as long as it is possible to set up the ball in the character-to-character time or less. If the character set-up time is greater than the increment time, then the carrier 1 is slowed down to give the ball positioning mechanism time to set up the ball before the carrier reaches the next print position. The carrier is then speeded up to the nominal print speed for printing to take place. FIG. 2 shows a possible velocity profile configuration for a 50 cps maximum rate printer.

This approach to carrier traverse has the advantage of increased throughput but requires more complex controls. A table or algorithm for determining traverse time based for example on the table of FIG. 3 is located in the terminal logic. Based on the knowledge of the character to be printed, the character just printed and the carrier acceleration rate, the carrier velocity profile can readily be determined.

Using a stepper motor as the drive source for the carrier traverse provides a means for accurate positioning and velocity control. All velocities are obtained by driving the motor from an oscillator and counting down to obtain the drive pulses. Uniform acceleration and deceleration profiles are selected in order to minimize electronic controls. Print hammer firing is determined by counting stepper motor steps until the proper carrier displacement has been achieved. Because printing always occurs at the same speed, no compensation is needed for hammer flight time.

This method of obtaining increased speed for a ball type printer, may also be used with any other type of print element such as for example a disc or wheel using engraved type and requiring variable time to set up the character for printing.

While FIG. 2 shows a desired velocity profile to accomplish the required carrier slow down function, in practice three problems occur with implementing this approach. They are: (1) the linear velocity ramps are not easily produced, (2) the variable time $t_c$ is undesirable because any tendency for velocity overshoot will cause differing velocities at print time and (3) the various time segments that must be produced do not bear simple relationships to each other so they are difficult to produce. The preferred way since the stepper motor 8 is driving the carrier, 1, is simply to cause the correct number of motor advance pulses in the desired time. Of course this must occur within acceptable deceleration and acceleration rates in the particular system.

Figure 4:
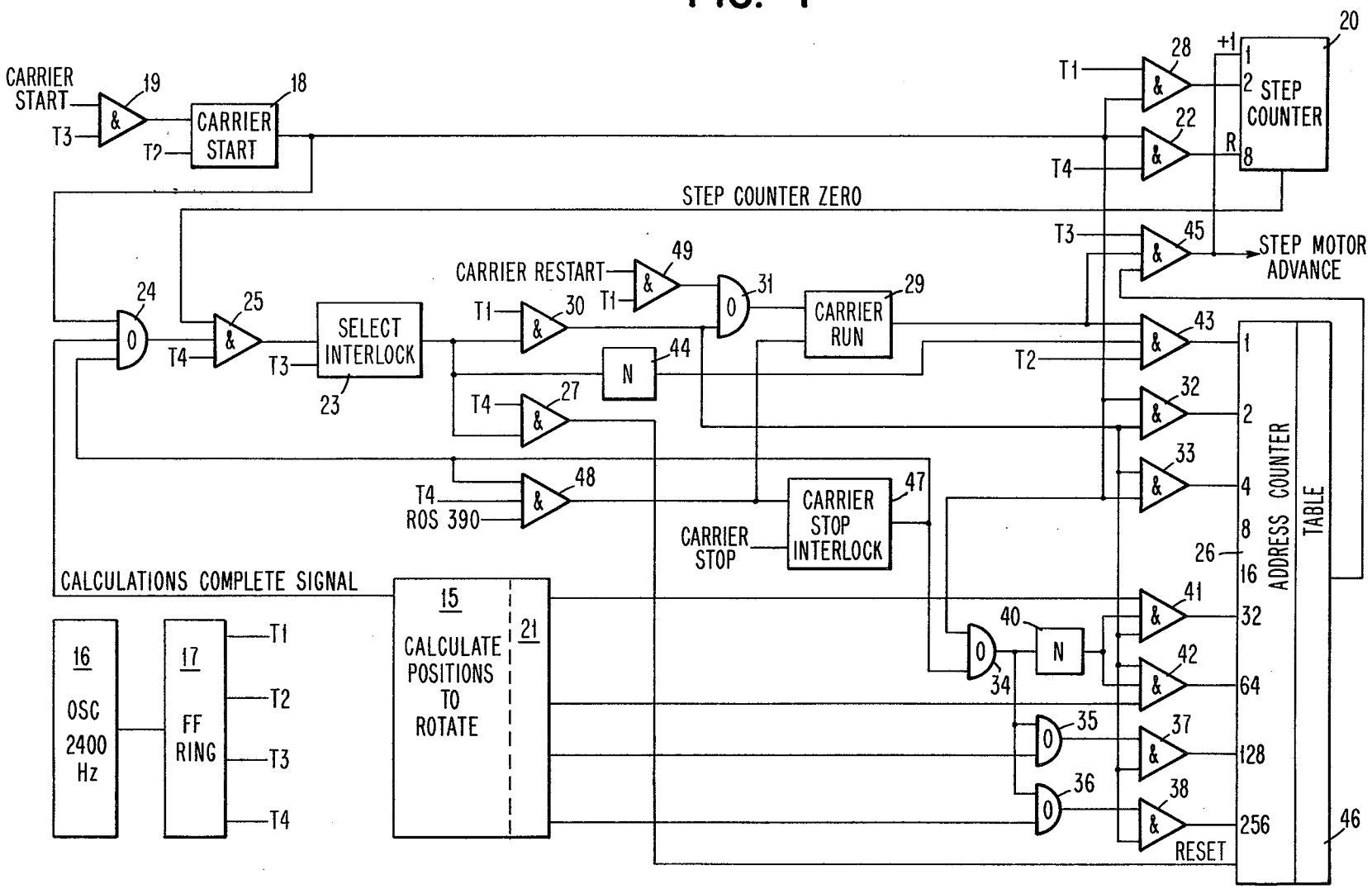
FIG. 4 is a schematic circuit diagram of a carrier traverse control for the serial printer structure such as shown in FIG. 1.

An actual implementation shown in FIG. 4 utilizes a stepper motor drive system that requires 12 advance pulses to move the carrier 1 one column or at 50 cps maximum, the clock frequency for the carrier drive is 600 Hz. By driving the stepper motor at discrete lower stepping rates (300Hz, 200Hz or stopped) the desired slow-down function is produced with a minimum of control logic.

Figures 5, 6:
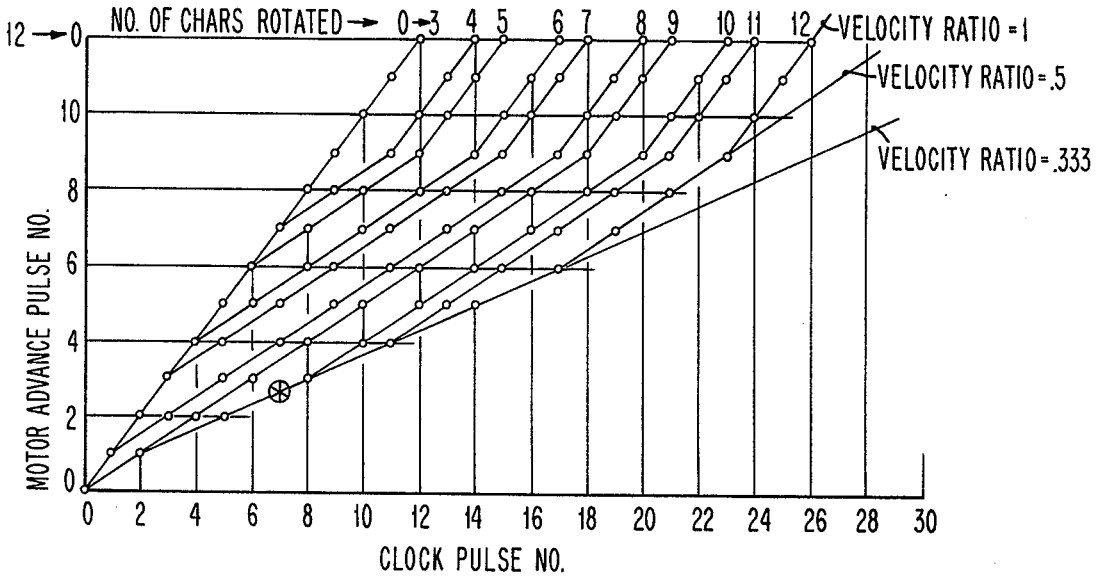
FIG. 5 shows a family of displacement profile curves illustrating different operating conditions of the system of FIG. 3.
FIG. 6 is a table showing the placement of bits in the ROS for controlling the carrier in accordance with the curves of FIG. 5.

FIG. 5 is a graph that shows the time required for the carrier 1 to move exactly one column (12 step motor advance pulses) as a function of the number of characters a particular rotating print element 2 must be rotated to print the next character. Time in this graph is simply the clock pulse number times one, divided by the clock frequency (600Hz in this case). It is the displacement diagram for the time versus rotated characters in FIG. 7.

By advancing the step motor 8 each clock pulse (1.667 ms) the carrier 1 moves continuously at 5 inches or 50 characters per second for print element rotations of zero through three characters. If, for example, the rotation of 12 characters is required, the advance pulses are chosen as clock pulses numbers 2, 5, 8, 11, 14, 17, 19, 21, 23, 24, 25 and 26. More than twice as much time is used to move one column to allow the correct print element time to rotate into position to print.

The pulse intervals for all conditions are chosen to (a) not violate step motor torque limits, (b) provide acceptably smooth acceleration and deceleration rates and (c) always print (at step zero) at the same time following completion of an acceleration phase to minimize registration problems if overshoot is not zero. The intervening curves depict the pulse numbers chosen for print element required rotation between 3 and 12 characters. It can be appreciated that any desired slow down profile can be designed for a particular number of motor steps per column, number of characters to be rotated and the respective times allowed for rotation.

Start and stop sequencing must be provided, and a designated sequence is always as if 12 characters must be rotated so that on start up complex synchronization is not required. Regardless of the rotate distance the print element has rotated and stopped before the character is printed. The asterisk on the curve for 12 characters rotation at clock pulse 7 is the designated stop point: note there is not a motor advance pulse at that time. After a stop indication is received, two stop sequence advance pulses of decreasing frequency (at clock pulses 2 and 5) occur. When a start indication is received, the remainder of the 12 characters rotation curve is traced so that the carrier is accelerated according to that sequence.

FIG. 5 then is a family of curves that when implemented will cause a carrier to be in position to print just after the rotatable print element is stopped. The curves can be implemented by (a) logical circuits, (b) a ROS (read only store) memory that each time it is read out indicates how many clock pulses are skipped before a clock pulse is used to cause a step motor advance pulse or (c) a one-bit wide ROS memory that is addressed successively each clock pulse and the step motor advance pulses are caused simply by the presence of a ROS read out bit. (c) is the preferred embodiment because the associated circuitry is lower in complexity and cost.

FIG. 6 is a chart showing the placement of bits ($x$) in the ROS table which is one-bit wide and 512 bits long although only 416 locations are used. The first column (number of characters to be rotated) selects the particular 32 bit section of ROS to be addressed by successive clock pulses; binary weighing of the 1, 2, 4 and 8 rotation counts selects the ROS address on a direct 1:32 ratio as depicted by the arrows from column 1 to column 2. When a bit ($x$) is read from ROS, the carrier step motor 8 advances one step. Observation between FIGS. 5 and 6 shows bits ($x$) in FIG. 6 correspond with the pulse to motor advance pulse relationship of the ten curves in FIG. 5. When an external counter has reached 12, ROS address advancement is terminated for that curve and a new start address is selected for the next character to be printed.

It can be seen that the last three pulses for any curve are never delayed so a modified implementation could (a) count 9 pulses from ROS memory and (b) insert the last three logically. The ROS positions per curve could then be limited to 24 so that a one bit wide 256 bit long ROS would suffice. The asterisk at address 390 is the "stopped" location equivalent to that on curve for 12 characters rotation in FIG. 5.

FIG. 4 is a schematic block diagram implementation of the traverse control system of the present invention. Block 15 contains the logic to control the rotatable print element 2; it would include a register 21 which contains the number of character positions the element 2 might be rotated to print the next character at a signal which indicates when the next character is ready (calculation complete signal). Block 16 is a common 2,400 Hz oscillator and block 17 is a common trigger ring such that each pulse is produced at the required 600 Hz rate. These pulses are used throughout the circuit to allow the proper timing of circuit functions.

When an initial start signal is received, carrier start flip-flop 18 is set through AND 19 during time T3. This flip-flop initializes the circuit to start according to the displacement curve for rotation of 12 characters as follows: at time T4 step counter 20 is reset through AND 22, select interlock flip-flop 23 is set through OR 24 and AND 25, and the ROS address counter 26 is reset through AND 27. At time T1 the step counter 20 is preset to a count of 2 through AND 28 because the start is at a point two steps along the curve 12 as shown in FIG. 5 and a carrier run flip-flop 29 is set through AND 30 and OR 31. The ROS address counter 26 is preset to address 390 through ANDs 32 and 33, ORs 34, 35 and 36 and ANDs 37 and 38 while the one bit and two bit positions of the positions-to-rotate register 21 cannot transfer to counter 26 by the blocking action of inverter 40 and ANDs 41 and 42.

At time T2 flip-flop 18 is reset but the ROS address counter 26 will not advance through AND 43 because it is blocked by inverter 44 while the select interlock flip-flop 23 is on. At time T3 select interlock flip-flop 23 is reset but there will be no step motor advance pulse through AND 45 because there is no bit from the ROS tables 46 at address 390 (see asterisk in FIG. 6). The startup routine is complete and the run flip-flop 29 is left on, the ROS address is 390, and the step counter 20 is at the correct value of 2.

While the carrier run flip-flop 29 is on, the ROS address counter 26 is advanced each T2 time through AND 43; at each T3 time if a bit is present at the output of ROS table 46, AND 45 will produce a step motor advance pulse and increment the step counter 20. When step counter 20 reaches the value of 12 it automatically resets to zero: this signals the completion of any displacement profile curve and the next curve must be selected during the following clock period to maintain a controlled step motor velocity. The rotate logic 5 will present a "calculation complete" signal through OR 24 prior to this time if more characters remain to be printed.

At time T4 through AND 25 select interlock flip-flop 23 will be set. At time T1 since start flip-flop 18 is off, the entire contents of rotate register 21 is preset into the ROS address counter 26 through ORs 35 and 36 and ANDs 37, 38, 41 and 42 according to the relationship between columns 1 and 2 of FIG. 6. Again no counter advance pulse is passed through AND 43 while flip-flop 23 and inverter 44 are on; they turn off at T3 and the selected displacement curve will be followed until the step counter 20 again goes through a count of 12 to zero.

When a carrier stop is desired, the curve for 12 rotate positions is to be followed until ROS address 390, at which time the step motor advance pulses are prevented indefinitely pending the input of a carrier restart signal. A carrier stop signal can be received at any time and immediately sets the carrier stop interlock flip-flop 47 but no further action is allowed until the step counter 20 goes to zero at the end of any selected curve. When that occurs, the select interlock flip-flop 23 is again set through OR 24 and AND 25. Since the step motor stop sequence is to progress according to the curve for 12 rotate positions, OR 34, inverter 40 and ANDs 41 and 42 block rotate register 21 and ORs 35 and 36 and ANDs 37 and 38 force a "12" equivalent address of 384 into counter 26. The select interlock flip-flop 23 functions in the usual sequence and the ROS is advanced 385, 386, etc. When the address is at 390 AND 48 resets flip-flops 29 and 47 so that all functions cease; the step counter 20 will be at 2 because 2 bits were received from the ROS table 46 so that conditions are exactly as preset initially by carrier start flip-flop 18. When a carrier restart signal is received asynchronously, carrier run flip-flop 29 is synchronously set through AND 49 and OR 31 at time T1 so that curve for 12 rotate positions will be continued, and a carrier stop and restart will have been completed. A pulse to fire a print hammer 10 is not shown but it is constructed logically at a particular step counter value and clock time such that the hammer impacts the paper at about the time the step counter 20 goes to zero because the carrier is always moving in exactly the same velocity (5 inches per second) just prior to and at that time regardless of earlier or later operation types.

Figure 7:
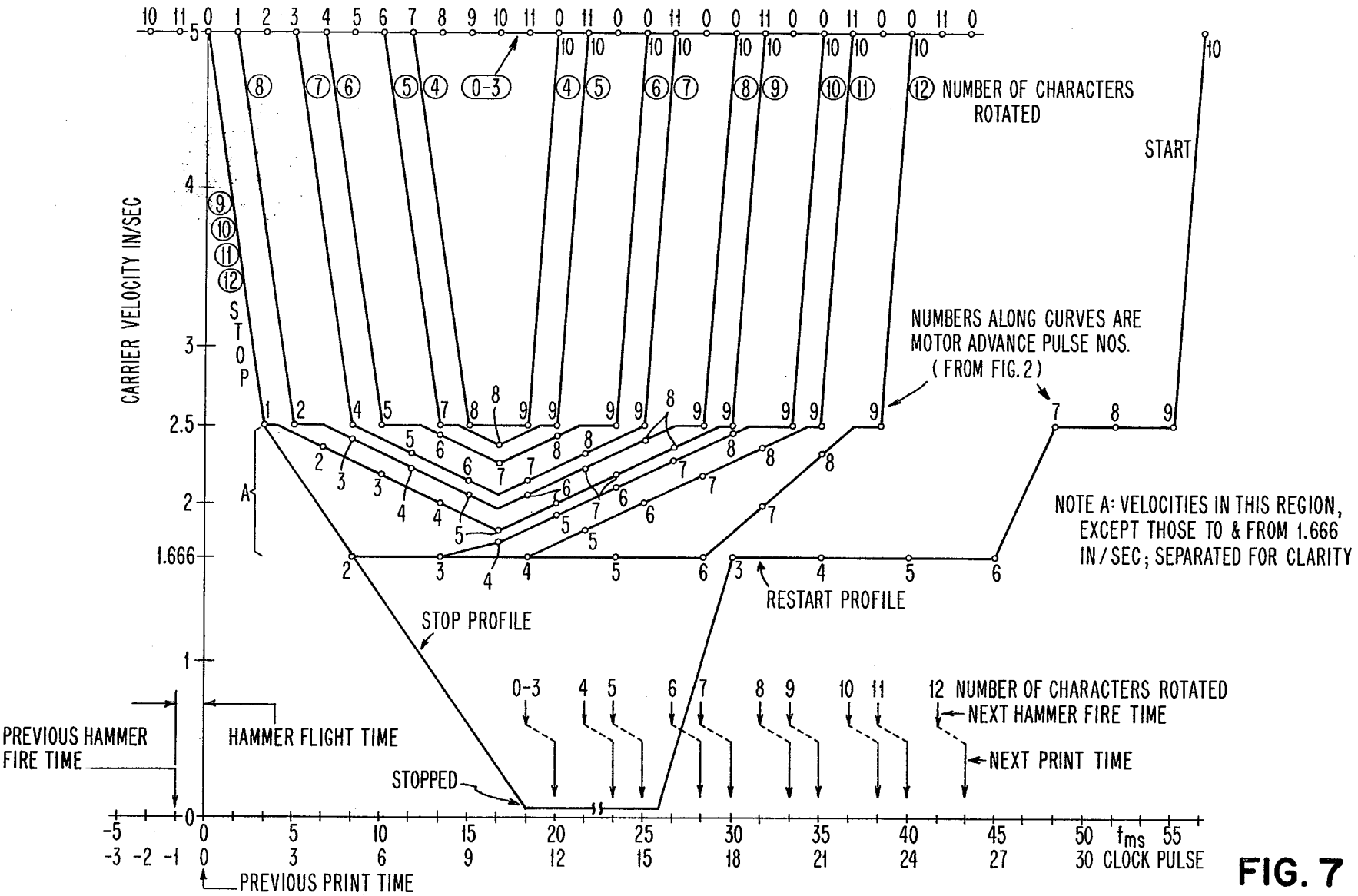
FIG. 7 is a family of velocity curves for the system of FIG. 4.

FIG. 7 is a velocity profile graph extracted from FIG. 6, the ROS table. The graph has been drawn with the aid of eight divisions per inch backup grid. The abscissa is clock pulses as in FIG. 5 and a time scale has been added to equate those pulses to an equivalent printing speed (inverse of the time required to move 12 motor steps). The ordinate is velocity and four discrete values are used: stopped, 1.666, 2.5, and 5 in/sec.

At time T = 0, the carrier 1 will always be travelling at 5 in/sec. as a result of printing from a previous character. The controls select clock pulses from the abscissa exactly as given for FIG. 5. To get the velocity profile for any number of characters rotated or for a stop and restart operation, start at the upper left corner and follow the profile having an encircled number equal to the number of characters rotated (or stop and restart). The small numbers along the profile are the motor advance pulses (ordinate of FIG. 5); when that number reaches 11, the hammer will fire and when it reaches 0 ( 12 pulses from the start), the print impact occurs. All velocities in the region A in the graph are actually at 2.5 in/sec. but are shown here separated so individual curves can be followed. Of course, the STOPPED profile can be at zero velocity for any period of time but is short here to allow the restart to be shown.

Any character would be printed at time T = 0 and velocity = 5 in/sec.; the hammer would have fired at clock pulse (−)1 thus the hammer flight time in this instance equals 1.666 ms, the time of one clock pulse. In any event, the flight time is a constant related to the abscissa.

All the possible hammer fire and impact (print) times for any number of characters rotated are shown just above the abscissa; as is stated elsewhere, all printing occurs at the constant velocity of 5 in/sec. Note that the hammer fire and print times are respectively located below motor advance pulse numbers 11 and 0 for any profile curve.

This section is a discussion of the circuitry in block 15 of FIG. 4 and how it is implemented. In this day and age, if a small microprocessor were associated with the printer, it would be used to calculate the number of character positions the print wheel must be rotated. In any event, the process of accomplishing that is to be associated with the means to cause the print wheel to rotate the required distance in the required time and is not the subject of this disclosure. However, in order to afford a complete disclosure for the present invention a particular hardware implementation for the rotate calculations is provided in FIG. 8.

The rotate calculation scheme herein described is for a print element having 24 characters for one revolution of the element at a particular elevation/inclination with four such elevations for a total of 96 possible characters. This set of conditions can be generalized to have any number of elevations and any even number of characters/revolution with the ROS table herein described having a length given by the product of the two numbers. The characters can be ordered in any manner, preferred or otherwise, because the table contains the location of the character mechanically with respect to a home position rather than the character code itself. The calculation scheme uses a number system whose base is equal to one-half the number of characters/revolution on the print element.

Figure 8:
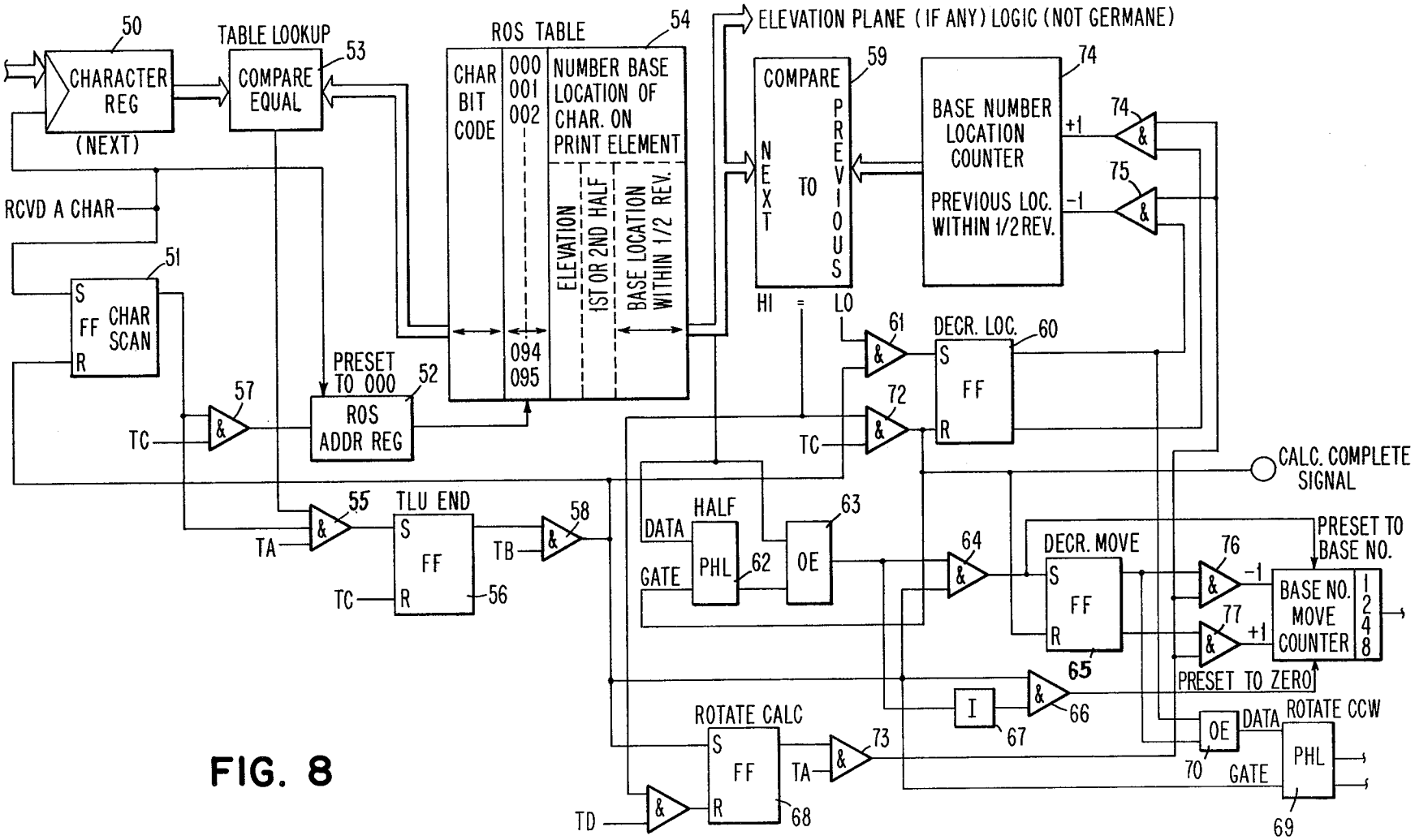
FIG. 8 is a schematic circuit diagram of a typical circuit for the "positions to rotate" block of FIG. 4.

FIG. 8 is a schematic hardware embodiment of the block 15 in FIG. 4. Initially, a character to be printed must be on the data bus and a "RCVD A CHAR" signal would be present to (a) gate the data bus into the NEXT character register 50, (b) sets the character scan flip-flop 51 ON and (c) preset the ROS address register 52 to zero; this would occur at clock time TD which is one of clock pulses TA — TD from a 500KHz — 1MHz oscillator for example. The table lookup compare circuit 53 is constantly comparing the character in register 50 to the character selected from the ROS table 54 by the address register 52 and will provide an EQUAL output when they do equate.

At each time TA during table lookup AND 55 tests for equality and if that be so, the TLU end flip-flop 56 will be set ON. When compare 53 is unequal, time progresses to TC and the ROS address register 52 is incremented by 1 through AND 57. This process repeats until the next character to be printed 50 is found in the table 54 and the TLU end flip-flop 56 is set at time TA thru AND 55. At time TB thru AND 58 the character flip-flop 51 is reset with the result that the ROS table 54 has the desired right side output which is the physical location of the next character to print on the wheel 2 as it relates to a home position. That location is described by a number from zero to one-half the number of characters in a revolution, a zero or one to tell which half revolution the character is located and, if more than one row of characters exists (i.e., on a stick or ball element), an elevation number selecting the row.

Also during the pulse thru AND 58, the calculation scheme is set up to arrive at the desired result. If the location counter 71 is to be decremented, compare 59 will have a LOW output and the decrement location flip-flop 60 will be set ON through AND 61. The HALF polarity hold latch 62 contains which one-half revolution the present character is located in and that is compared with the next character one-half location from ROS table 54 in Exclusive OR 63 that yields an output if the two halves are unequal. If they are unequal, AND 64 is gated to (a) preset the move counter 21 to the base number (of characters in one-half revolution ) and (b) set the decrement move flip-flop 65 ON; if they are equal, AND 66 is gated through inverter 67 to preset the move counter 21 to zero. During this same clock interval, the rotate calculation flip-flop 68 is set ON and the rotate CCW (counterclockwise) polarity hold latch 69 is gated; it will be left OFF if the exclusive OR 70 is OFF as a result of the decrement location and move flip-flops 60 and 65 being in the same state or it will turn ON if EOR 63 is ON because flip-flop 60 and 65 are in opposite states.

During the next clock time TC, the TLU end flip-flop 56 is reset and the rotation calculation is beginning; recall that the direction of rotation that yields the shortest distance to the next character is already predetermined since CW (clockwise) rotation will result if the rotate CCW polarity hold latch 69 is left OFF.

During this first or any successive time TC, the calculation will end when the number in the base location counter 71 equals the base location number presented at ROS table 54 output; the equality is determined by the (=) output of compare 59 which gates through AND 72 and directly is the CALC complete signal that is used from block 15 in FIG. 4.

Until such time as the AND 72 is satisfied, succeeding clock times TA through AND 73 condition ANDs 74, 75, 76 and 77 to increment or decrement counters 21 and 71 as dictated by their respective decrement control flip-flops 60 and 65.

When the AND 72 is satisfied, the base no. location counter 71 contains the physical location of the next character to be printed (it now becomes the present character), the decrement flip-flops 60 and 65 will be reset if they were ON; the HALF polarity hold latch 62 is gated to accept the half-revolution location of the next character from the ROS table 54 which now also becomes the present character location and the two pieces of information required to control the carrier step motor circuits of FIG. 4 are ready (a) the base move counter value 21 in FIG. 8 is the calculate positions to rotate register 21 in FIG. 4 and the calc complete signal tells the control circuits of FIG. 4 to begin controlling the step motor velocity as it has been preprogrammed to do with the particular rotate value presented in register 21.

Again it is understood that the scheme as hereinbefore implemented is for a duo-decimal base number because the particular print element has 24 characters/revolution but the scheme is adaptable to any even number of characters/revolution.

While the invention has been particularly shown and described with reference to a preferred embodiment thereof, it will be understood by those skilled in the art that various changes in form and details may be made therein without departing from the spirit and scope of the invention.

What is claimed is:

1. The combination in a printer apparatus, comprising a carrier movable along the print line of a document, a print mechanism movable with said carrier including a type element having a plurality of type characters thereon movable on said carrier to present selected ones of said characters into position for printing at successive print locations of said print line, drive means for moving said carrier along said print line, and means for controlling the motion of said carrier along said print line including pulse means operable for providing pulses to operate said drive means, means for determining the number of character positions said type element must move on said carrier to position the next type character for printing, and means responsive to said determining means for for operating said pulse means at selectively variable rates to provide different ones of a plurality of predetermined pulse sequences to said drive means, whereby said drive means moves said carrier at a predetermined fixed velocity so long as said number of character positions does not exceed a predetermined number, at selectively variable velocities between print locations when said number of character positions exceeds said predetermined number, and at said fixed velocity during printing of said type characters on said document, said control means further comprising a read only storage device having a plurality of stored programs each effective to apply different ones of said sequences of pulses from said pulse means to said drive means.

2. The invention as defined in claim 1 characterized by said means for determining the number of positions the type element must move being connected to said read only storage means to select different ones of said stored programs.

3. The invention as defined in claim 2 characterized by each of said stored programs providing a different pulse sequence and velocity profile for said drive means and decode means connecting said means for determining the number of positions the type element must move to said read only storage means for selecting the appropriate program.

4. The invention as defined in claim 3 characterized by gate means controlled by said read only storage means connecting said pulse means to said drive means.

* * * * *